US005108209A

United States Patent [19]

Menzenski

[11] Patent Number: 5,108,209

[45] Date of Patent: Apr. 28, 1992

[54] APPARATUS AND METHOD FOR DETECTING DEPLETION OF INK IN AN INK RIBBON

[75] Inventor: Gregory Menzenski, Ithaca, N.Y.

[73] Assignee: NCR Corporation, Dayton, Ohio

[21] Appl. No.: 551,227

[22] Filed: Jul. 11, 1990

[51] Int. Cl.[5] ..... B41J 35/36

[52] U.S. Cl. ..... 400/249; 400/208; 400/703; 400/712

[58] Field of Search ..... 400/208, 219, 247, 249, 400/219.1, 703, 712

[56] References Cited

U.S. PATENT DOCUMENTS

| | | | |
|---|---|---|---|
| 4,268,182 | 5/1981 | Mizutani et al. | 400/247 |
| 4,375,339 | 3/1983 | Dyer et al. | 400/249 |
| 4,407,593 | 10/1983 | Haftmann | 400/208 |
| 4,662,766 | 5/1987 | Teichmann et al. | 400/208 |
| 4,676,678 | 6/1987 | Watanabe | 400/208 |
| 4,676,681 | 6/1987 | Kikuchi et al. | 400/247 |
| 4,678,139 | 7/1987 | Harry | 242/199 |
| 4,685,818 | 8/1987 | Kazarian et al. | 400/249 |
| 4,728,206 | 3/1988 | Mori et al. | 400/225 |
| 4,728,207 | 3/1988 | Foster | 400/225 |
| 4,729,676 | 3/1988 | Smith et al. | 400/248 |

FOREIGN PATENT DOCUMENTS

| | | | |
|---|---|---|---|
| 0236676 | 10/1988 | Japan | 400/249 |

*Primary Examiner*—Edgar S. Burr
*Assistant Examiner*—Christopher A. Bennett
*Attorney, Agent, or Firm*—Matthew R. Jenkins

[57] ABSTRACT

A method and apparatus for electronically determining when a ribbon cassette in a printer should be replaced. The ribbon cassette comprises a housing and an electrically conductive ink ribbon stored in the housing. The apparatus comprises a detection apparatus which includes a first conductor and a second conductor which pass through the housing and contact the ink ribbon, thereby enabling a signal to be generated when the electrical resistance of the ink ribbon equals a predetermined resistance. A controller coupled to the detection apparatus causes a message that the ribbon cassette needs to be replaced to be displayed on a display in response to the signal. The method entails generating a first signal corresponding to the electrical resistance of at least a portion of the ink ribbon; and then generating a second signal when the first signal equals a third signal corresponding to the predetermined resistance of the ink ribbon.

7 Claims, 3 Drawing Sheets

APPARATUS AND METHOD FOR DETECTING DEPLETION OF INK IN AN INK RIBBON

BACKGROUND OF THE INVENTION

1. Field of the Invention

This invention relates to ink ribbon cassettes, and more particularly, to a method and apparatus for determining when a ribbon in a ribbon cassette should be replaced.

2. Description of Related Art

The use of ribbon cassettes in printers has become quite common. Ribbon cassettes are advantageous because they can be easily installed in and removed from the printer. A problem in the prior art is that it was difficult to determine when the ribbon cassette needed to be replaced. The printer would print data having a desired density during normal operation. However, the printer would print data having an undesirable density if the ink ribbon in the ribbon cassette did not have a sufficient ink content. This often resulted in the printer printing illegible data on a document before an operator was made aware that the ribbon cassette needed to be replaced. This was particularly true where the printer was not continuously attended by the operator. Any documents having illegible printing would have to be discarded and new documents would have to be reprinted.

There is, therefore, a present need to provide a means for automatically determining when to replace a ribbon cassette in a printer which means is inexpensive, easy to implement, and not time consuming to use.

SUMMARY OF THE INVENTION

In one aspect of the invention, there is provided a ribbon cassette comprising: a housing; an ink ribbon stored in the housing, said ink ribbon having a measurable electrical resistance; and first and second conductors passing through the housing and contacting the ink ribbon to enable the electrical resistance of the ink ribbon to be measured. The electrical resistance of the ink ribbon is directly proportional to its ink content, and can be used to determine when a ribbon cassette has too little ink on its ribbon to be useful.

In another aspect of the invention, there is provided a method for generating a signal when a ribbon cassette having an ink ribbon therein needs to be replaced, said ink ribbon having a measurable electrical resistance; said method comprising the steps of: (a) generating a signal corresponding to the electrical resistance of at least a portion of the ink ribbon; and (b) generating an alarm signal when the electrical resistance of the ink ribbon equals a predetermined resistance.

It is therefore an object of this invention to provide means for permitting the ink content of an ink ribbon in a ribbon cassette to be easily determined.

Another object of this invention is to provide a means for generating an alarm signal when a ribbon cassette needs to be replaced.

Yet another object of this invention is to provide a method for determining when a ribbon cassette is no longer useful.

Still another object of this invention is to provide a method for warning an operator when a ribbon cassette needs to be replaced.

These objects and others will become apparent from the following description, drawing, and claims which accompany and form a part of this specification.

DESCRIPTION OF THE PREFERRED EMBODIMENT

Figure 1:
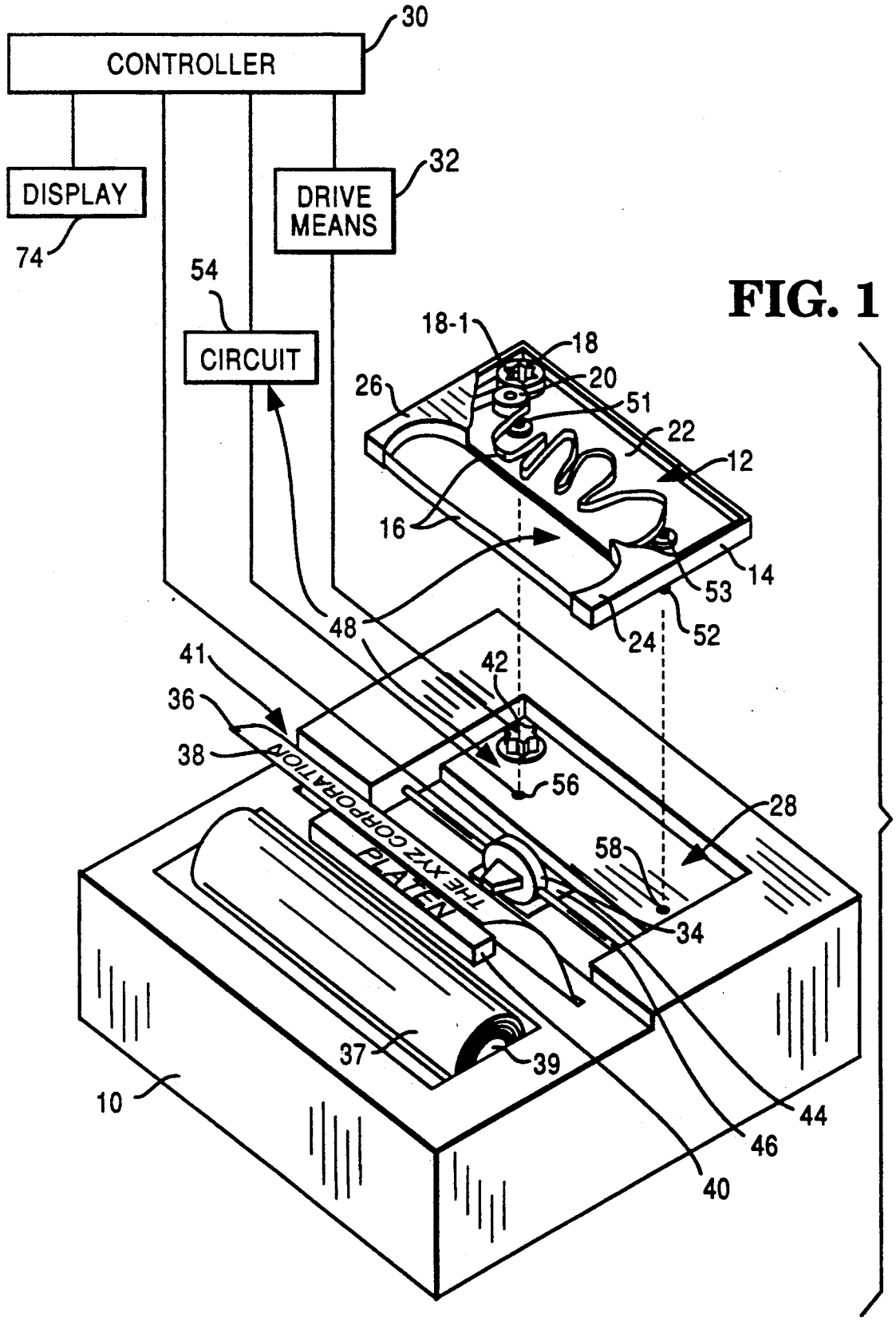
FIG. 1 is an isometric view of a printer and a ribbon cassette according to the present invention, with portions of the ribbon cassette broken away to reveal its construction.
Figure 2:
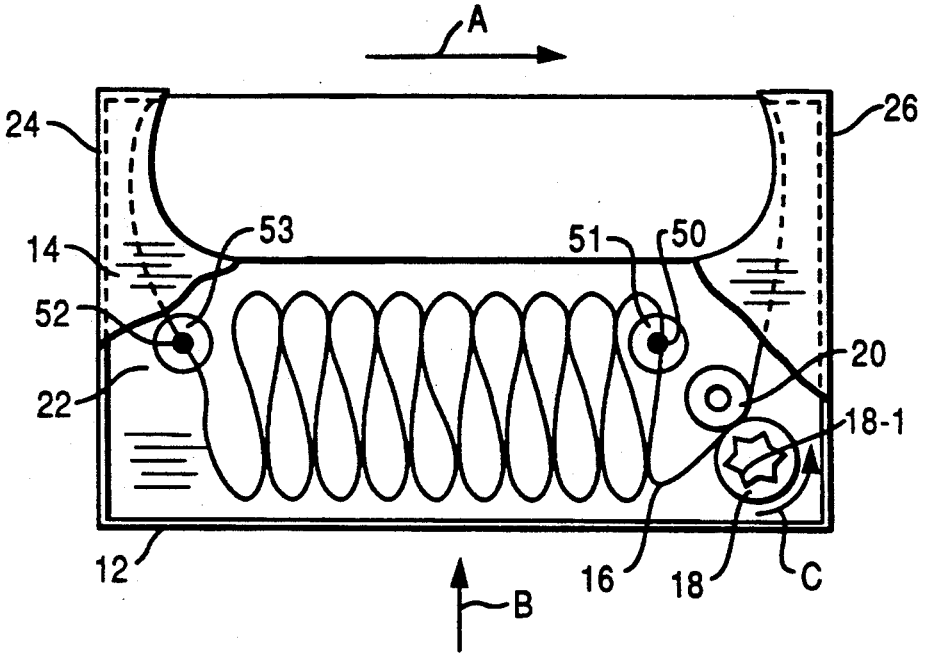
FIG. 2 is a top view of the ribbon cassette, partly broken away, showing an ink ribbon, a stuffing chamber, first and second ribbon guide arms, and first and second conductors associated with the ribbon cassette and contacting the ink ribbon.
Figure 3:
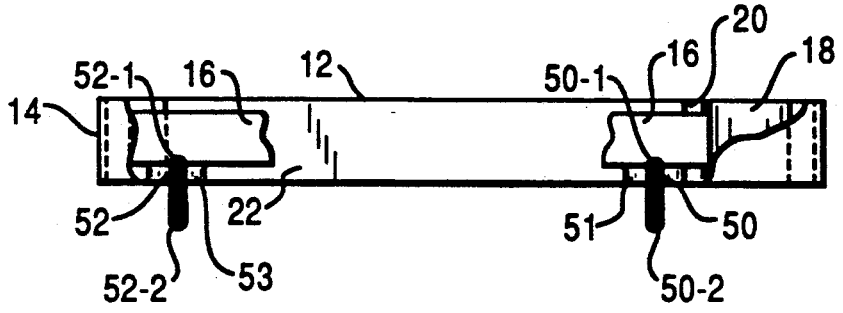
FIG. 3 is an end view, taken in the direction of arrow B in FIG. 2 and partly broken away, showing the first and second conductors mounted in the ribbon cassette.

FIG. 1 shows a printer 10 in which a ribbon cassette 12 according to this invention may be used. The ribbon cassette 12 (which is also seen in FIGS. 2 and 3) includes a housing 14 which is used to store and support an ink ribbon 16. The ink ribbon 16 includes a conventional carbon solid ink (not shown) which enables the ink ribbon 16 to have a measurable electrical resistance. In a preferred embodiment, the ink ribbon 16 is 40 feet long, endless and re-usable. The ribbon cassette 12 further includes a drive roller 18 and a cooperating roller 20 which cooperates with the drive roller 18 to move the ink ribbon 16 in the direction indicated by arrow A in FIG. 2. The ink ribbon 16 is drawn out of a stuffing chamber 22 through a first ribbon guide arm 24 and is guided back into the stuffing chamber 22 through a second ribbon guide arm 26. A portion of the ink ribbon 16 is exposed at all times between the first and second ribbon guide arms 24 and 26 for use in printing.

The printer 10 (FIG. 1) comprises a cassette receiving opening or means 28 for receiving the ribbon cassette 12. The cassette receiving means 28 has a shape which is generally complementary to the shape of the housing 14 of the ribbon cassette 12. As depicted schematically in FIG. 1, the printer 10 also includes a controller 30 for controlling the operation of the printer 10. The controller 30 is coupled to drive means 32 for driving the drive roller 18 of the ribbon cassette 12. The drive means 32 includes a drive sprocket or pin 42 which engages a complementary-shaped interior aperture 18-1 of the drive roller 18. When the drive roller 18 rotates in a counterclockwise direction (as indicated by arrow C in FIG. 2), the ink ribbon 16 is drawn out of the stuffing chamber 22 in the direction of arrow A through the first ribbon guide arm 24 and is guided back into the stuffing chamber 22 through the second ribbon guide arm 26. The controller 30 is also conventionally coupled to a print member 34 for impacting the ink ribbon 16 against a document 36 and a platen 40 in order to print data 38 on the document 36. The document 36 is provided from a supply roll 37 which is mounted on a supply spool 39 driven by a motor (not shown) in the printer 10.

The print member 34 is conventionally mounted on a carriage 44 which is slidably mounted on a support rod 46. The motor in the printer and its associated drive pulleys (not shown) are controlled by the controller 30 and are also coupled to the carriage 44 to move the carriage 44 and the print member 34 along the support rod 46. The print member 34 is associated with the cassette receiving means 28 so that the exposed portion of the ink ribbon 16 becomes operatively positioned relative to the print member 34 when the ribbon cassette 12 is mounted in the printer 10. The print member 34 forces the ink ribbon 16 against the document 36 and the platen 40 in order to print the data 38 on the document 36 when the document 36 is positioned at a print station 41 between the print member 34 and the platen 40.

The preferred embodiment of the invention has a detection apparatus 48 which includes a first conductor 50 and a second conductor 52 which enable the electrical resistance of the ink ribbon 16 to be measured. The first and second conductors 50 and 52 are made of a suitable conductive material such as copper and are secured in a first receiving boss 51 and a second receiving boss 53, respectively, which may be integrally molded as part of the housing 14 of the ribbon cassette 12 as best illustrated in FIG. 3. In the preferred embodiment, the first and second conductors 50 and 52 are spaced approximately four inches apart. The first conductor 50 has a first end 50-1 and a second end 50-2, and the second conductor 52 has a first end 52-1 and a second end 52-2. As best illustrated in FIGS. 1 and 2, the first ends 50-1 and 52-1 contact the ink ribbon 16 in the stuffing chamber 22.

Figure 4:
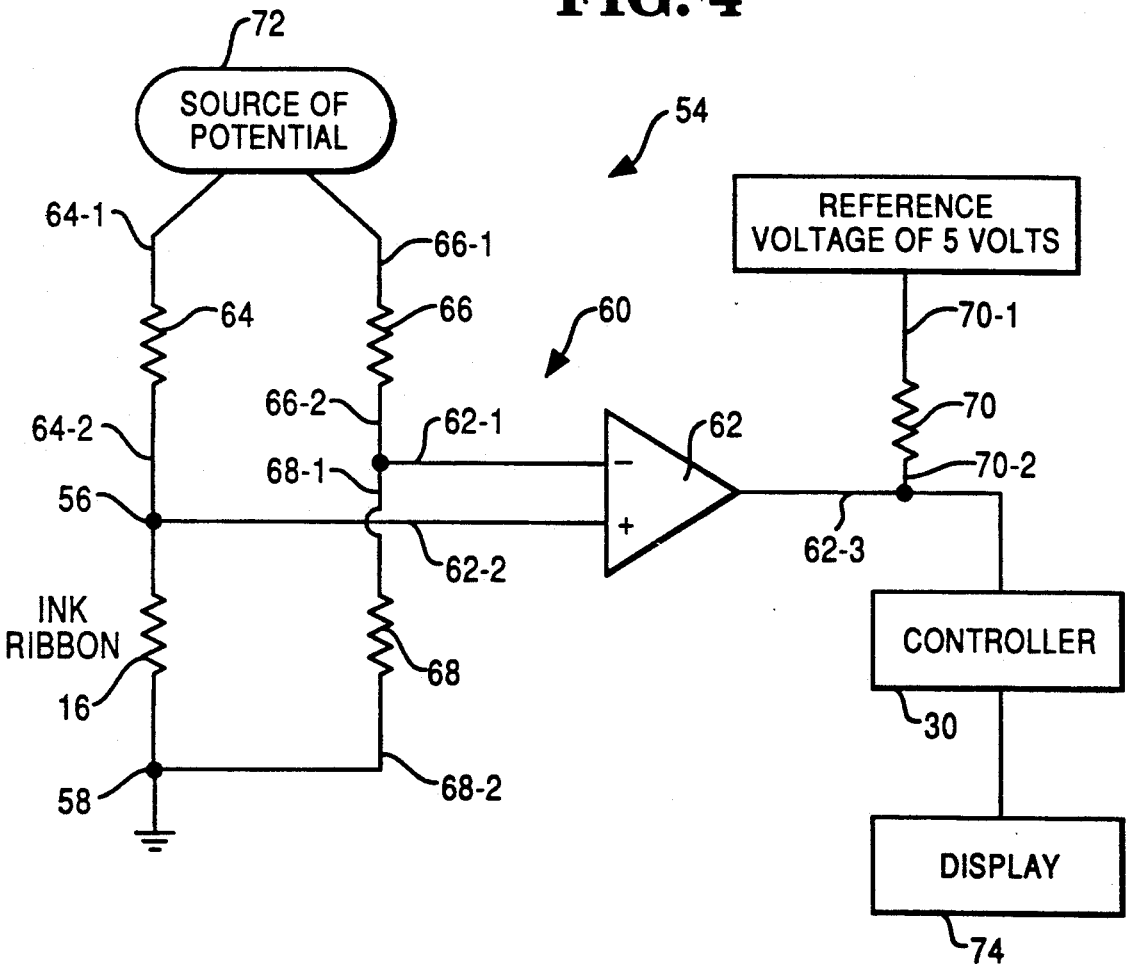
FIG. 4 is a general schematic diagram of a circuit used to generate an alarm signal when the electrical resistance of the ink ribbon equals a predetermined resistance.

The detection apparatus 48 also includes a circuit 54 (the details of which are shown in FIG. 4) for generating an alarm signal when the electrical resistance of the ink ribbon 16 equals a predetermined resistance. As seen in both FIGS. 1 and 4, the circuit 54 includes a third conductor 56 and a fourth conductor 58 which are located in the printer 10. The third conductor 56 and fourth conductor 58 contact the second ends 50-2 and 52-2 of the first and second conductors 50 and 52, respectively, when the ribbon cassette 12 is mounted in the printer 10. The circuit 54 further includes comparator means or circuit 60 for generating the alarm signal when the electrical resistance of the ink ribbon 16 equals the predetermined resistance. The comparator circuit 60 comprises an operational amplifier 62 having a first input conductor 62-1, a second input conductor 62-2, and an output conductor 62-3. The second input conductor 62-2 of the operational amplifier 62 is coupled to the third conductor 56. The circuit 54 further comprises a first resistor 64, a second resistor 66, a third resistor 68, and a fourth resistor 70. The first resistor 64 has one end 64-1 thereof coupled to a source of potential 72 and a remaining end 64-2 thereof coupled to the third conductor 56. The second resistor 66 has an end 66-1 coupled to the source of potential 72 and a remaining end 66-2 coupled to the first input conductor 62-1. The third resistor 68 has an end 68-1 coupled to the first input conductor 62-1 and a remaining end 68-2 coupled to the fourth conductor 58. The fourth resistor 70 has an end 70-1 coupled to a reference voltage of 5 volts, and a remaining end 70-2 is coupled to the output conductor 62-3. The output conductor 62-3 of the operational amplifier 62 is coupled to the controller 30, and the fourth conductor 58 is coupled to ground. The electrical resistance of the ink ribbon 16 is measured between the first and second conductors 50 and 52 which are coupled to the third and fourth conductors 56 and 58, respectively, when the ribbon cassette 12 is mounted in the printer 10. The ink ribbon 16 is shown as a resistor in FIG. 4.

The operational amplifier 62 will generate the alarm signal at the output conductor 62-3 when the voltage at the second input conductor 62-2 exceeds the voltage at the first input conductor 62-1. As the ink ribbon 16 is used, the electrical resistance of the ink ribbon 16 increases and raises the voltage level at the third conductor 56, thereby causing a first signal corresponding to the measured resistance of the ink ribbon 16 to be generated at the second input conductor 62-2. The predetermined resistance mentioned previously herein may be programmed or adjusted by selecting the appropriate resistor values for the first, second, third, and fourth resistors 64, 66, 68, and 70. When the voltages on the input conductors 62-1 and 62-2 are equal, the operational amplifier 62 generates the alarm signal at the output conductor 62-3. The alarm signal generated at the output conductor 62-3 is received by the controller 30 which causes a message to be displayed on a display 74 coupled to the controller 30. The message alerts the printer operator that the ink ribbon 16 needs to be replaced. Due to the expected changing resistance of the ink ribbon 16 through use, the controller 30 may sample the alarm signal only when the ink ribbon 16 is not being advanced. Also, the controller 30 may sample the alarm signal several times before the message is displayed on the display 74 in order to verify that the ink ribbon 16 has a low ink content.

Circumstances under which the alarm signal might be generated will now be described. Assume that the printer 10 prints the data 38 legibly when measured resistance of the ink ribbon 16 is 1.5K ohms or below. As the ink ribbon 16 is used, the ink on the ink ribbon 16 is removed which causes the data 38 to be printed illegibly or not at all. In the example being described, this would occur when the measured resistance of the ink ribbon 16 equals or exceeds a resistance of 1.5K ohms. For an ink ribbon 16 whose resistance is 1.5K ohms, the circuit 54 may be programmed as follows. In order to program the circuit 54 with the predetermined resistance of 1.5K ohms, the resistors 64, 66, 68, and 70 would be selected to have resistances of 2.2K, 2.2K, 1.5K, and 10K, respectively. It may be desired to select a predetermined resistance of 1.4K so that the alarm signal will be generated prior to the data 38 being printed illegibly. In order to program the circuit 54 with the predetermined resistance of 1.4K ohms, the first, second, third, and fourth resistors 64, 66, 68 and 70 (FIG. 4) could be selected to have resistances of 2.2K, 2.2K, 1.4K, and 10K, respectively.

Various changes or modifications in the invention described may occur to those skilled in the art without departing from the spirit or scope of the invention. For example, the ribbon cassette 12 may include openings (not shown) which permit probes (not shown) from a voltmeter or ohmmeter, for example, to be inserted therethrough in order to contact the ink ribbon 16. The electrical resistance of the ink ribbon 16 could then be measured when the ribbon cassette 12 is stored on a shelf in inventory. The above description of the invention is intended to be illustrative and not limiting, and it is not intended that the invention be restricted thereto but that it be limited only by the true spirit and scope of the appended claims.

What is claimed is:

1. A ribbon cassette comprising:

a housing;

an ink ribbon stored in the housing, said ink ribbon containing carbon material and having a measurable electrical resistance;

circuit means operably associated with said ink ribbon for measuring the electrical resistance thereof; and first and second conductors spaced from each other and adjacent the sides in said housing of said cassette and each conductor having an end portion contacting said ink ribbon, said circuit means including a third conductor and a fourth conductor each having an end portion contacting the end portions of said first conductor and said second conductor, respectively, and said circuit means further including comparator means and resistor means operably coupled to said third and said fourth conductors and to said comparator means to enable the electrical resistance of said ink ribbon to be measured upon usage thereof relative to a predetermined resistance of said ink ribbon.

2. A detection apparatus for detecting electrical resistance of an ink ribbon having carbon material in the ink of said ribbon, said ink ribbon being stored in a housing of a ribbon cassette when the ribbon cassette is mounted in a printer, said ink ribbon having a measurable electrical resistance of said carbon material, said detection apparatus comprising:

first and second conductors which contact said ink ribbon; and a circuit coupled to said first and second conductors, said circuit including a third conductor and a fourth conductor engaging said first and said second conductors, respectively, said circuit further including comparator means for generating a signal when the electrical resistance of the carbon material in said ink ribbon upon usage thereof equals a predetermined resistance, said circuit further including a plurality of resistors operably coupled to said third and said fourth conductors and to said comparator means, the values of said resistors being selected whereby said comparator means compares the resistance of said ink ribbon after usage thereof with said predetermined resistance for generating said signal.

3. The detection apparatus as recited in claim 2 in which said comparator means further comprises an operational amplifier having first and second input conductors and an output conductor;

said circuit further comprising:

first, second, third, and fourth resistors; said first resistor having one end coupled to a source of potential and a remaining end coupled to said third conductor, said second resistor having one end coupled to said source of potential and a remaining end coupled to said fourth conductor; said third resistor having one end coupled to said fourth conductor and a remaining end coupled to ground; said fourth resistor having one end coupled to a reference voltage and a remaining end coupled to said output conductor;

said first and second conductors being coupled to said third conductor and ground, respectively, when said ribbon cassette is mounted in the printer;

said first and second input conductors of said operational amplifier being coupled to said fourth and third conductors, respectively; and said resistances of said first, second, third and fourth resistors being selected so that the operational amplifier will generate said signal at said output conductor when the voltage at said third conductor exceeds the voltage at said fourth conductor.

4. A printer comprising:

cassette receiving means for receiving a ribbon cassette having a housing with an ink ribbon therein, said ink ribbon having carbon material enabling a measurable resistance of the ink in said ribbon;

a controller for controlling the operation of the printer;

a print member coupled to said controller and associated with said cassette receiving means; said ink ribbon cooperating with said print member to print data on a document when said document is positioned in the printer; and a detection apparatus coupled to said controller for detecting the electrical resistance of the ink in said ink ribbon when the ribbon cassette is mounted in the printer;

said detection apparatus comprising:

first and second conductors spaced from each other and secured to said housing adjacent the sides thereof and each conductor having an end portion contacting said ink ribbon; and a circuit having third and fourth conductors each having an end portion operably coupled to the end portions of said first and second conductors and said circuit further having a plurality of resistors and an amplifier for comparing the resistance of the carbon material in the ink of said ink ribbon upon usage thereof and for generating a signal when the electrical resistance of the ink ribbon equals a predetermined resistance.

5. A method for generating a signal when a ribbon cassette having an ink ribbon therein needs to be replaced, said ink ribbon having carbon material enabling a measurable electrical resistance; said method comprising the steps of:

providing a first conductor and a second conductor spaced at a distance from each other on said ribbon cassette;

providing circuit means for measuring the carbon material of said ink ribbon, said circuit means having a plurality of resistors and comparator means operably coupled for measuring the resistance of said carbon material;

generating a signal corresponding to the electrical resistance of at least a portion of the ink ribbon; and generating an alarm signal when said first and second conductors engage said ink ribbon and when said circuit means determines that said electrical resistance of said ink ribbon equals a predetermined resistance.

6. A method for determined when a ribbon cassette is no longer useful, said ribbon cassette having a housing with an ink ribbon stored therein and with the ink ribbon having carbon material enabling a measurable electrical resistance of the ink in said ribbon; said method comprising the steps of:

providing a first conductor and a second conductor on said housing;

contacting said ink ribbon with said first and second conductors;

providing a circuit and connecting said first and second conductors to said circuit for measuring the electrical resistance of the ink in said ink ribbon;

measuring the electrical resistance with said circuit; and determining when the ribbon cassette is no longer useful based upon the electrical resistance measured with said circuit.

7. A method for determining when a ribbon in a ribbon cassette is no longer useful, said ribbon cassette having a housing with an ink ribbon stored therein and with the ink ribbon having carbon material enabling a measurable electrical resistance, said ribbon cassette having first and second conductors secured thereto which contact said ink ribbon; said method comprising the steps of:

providing a circuit for measuring the resistance of the ink in said ink ribbon;

connecting said first and second conductors to said circuit for measuring the electrical resistance of said ink ribbon;

measuring the electrical resistance of said ink ribbon with said circuit; and determining when the ribbon cassette is no longer useful based upon the electrical resistance measured with said circuit.

* * * * *